US009712903B2

(12) United States Patent
Ikeda

(10) Patent No.: US 9,712,903 B2
(45) Date of Patent: Jul. 18, 2017

(54) MICROPHONE HOLDER AND STEP FORMATION MEMBER USED WITH THE SAME, AND MICROPHONE SHOCK MOUNT USING THE MICROPHONE HOLDER

(71) Applicant: KABUSHIKI KAISHA AUDIO-TECHNICA, Machida-shi, Tokyo (JP)

(72) Inventor: Tatsuya Ikeda, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/920,177

(22) Filed: Oct. 22, 2015

(65) Prior Publication Data

US 2016/0119701 A1 Apr. 28, 2016

(30) Foreign Application Priority Data

Oct. 23, 2014 (JP) ..... 2014-215843

(51) Int. Cl.
*G10D 9/00* (2006.01)
*H04R 1/08* (2006.01)

(52) U.S. Cl.
CPC ..... *H04R 1/08* (2013.01); *G10D 9/00* (2013.01)

(58) Field of Classification Search
USPC ..... 248/534, 535, 541, 311.2, 312, 312.1; 84/453, 290, 329, 461, 462, 723, 725, 84/730, 743, DIG. 24
See application file for complete search history.

(56) References Cited

U.S. PATENT DOCUMENTS 5,357,577 A * 10/1994 Waji ..... H04R 1/04 361/704
2013/0061430 A1* 3/2013 Okita ..... H01F 7/0252 24/303
2013/0062479 A1* 3/2013 Okita ..... F16M 11/041 248/176.1
2016/0089726 A1* 3/2016 Domeij ..... B25B 5/147 279/96

FOREIGN PATENT DOCUMENTS

JP 2000-152360 A 5/2000

* cited by examiner

*Primary Examiner* — Alfred Wujciak
(74) *Attorney, Agent, or Firm* — Manabu Kanesaka

(57) ABSTRACT

A microphone holder holds a microphone in which an upper surface and a lower surface of a step portion are formed on an outer surface of a housing, and the microphone holder includes: a holder which is formed in a cylindrical shape having openings on upper and lower sides and in which a plurality of through passages penetrating a wall of the cylindrical shaped body is provided; a sliding portion provided movably in a circumferential direction along the openings of the holder; a lock ring configured to cover the through passage formed to the holder, from an outer side by a lock plate extending from the sliding portion; and a contact member which is movably held in the through passage and can contact on an upper surface side of the step portion of the microphone.

5 Claims, 15 Drawing Sheets

MICROPHONE HOLDER AND STEP FORMATION MEMBER USED WITH THE SAME, AND MICROPHONE SHOCK MOUNT USING THE MICROPHONE HOLDER

RELATED APPLICATIONS

The present application is based on, and claims priority from, Japanese Application No. JP2014-215843 filed Oct. 23, 2014, the disclosure of which is hereby incorporated by reference herein in its entirety.

BACKGROUND OF THE INVENTION

Field of the Invention

The present invention relates to a microphone holder and a step formation member used with the microphone holder, and a microphone shock mount using the microphone holder, and especially relates to a microphone holder, in which a microphone can be easily attached to and detached from, and a step formation member used with the microphone holder, and a microphone shock mount which can absorb vibration of the microphone holder holding a microphone.

Description of the Related Art

Conventionally, a microphone shock mount for absorbing vibration while holding a microphone includes, for example, a large diameter ring-shaped outer peripheral member 50 and a small diameter ring-shaped holder 55 arranged in a ring of the outer peripheral member 50 and configured to hold the microphone, as illustrated in FIGS. 17 and 18. The outer peripheral member 50 includes a screw portion 51 and can connect to a microphone stand.

A rubber string 57 is stretched between the outer peripheral member 50 and the holder 55. By this rubber string 57, the holder 55 is elastically suspended movable in vertical direction with respect to the outer peripheral member 50. In an illustrated example, a pair of rubber bands 58 (flat rubber) is stretched in parallel to a horizontal direction in the ring-shaped holder 55. A microphone housing (not illustrated) is sandwiched in the rubber band 58, and a rubber band 59 is fitted to a groove formed in the microphone housing. Thus the holder is held. A holder having such a configuration is disclosed in JP 2000-152360 A.

Further, in addition to the above-described configuration, examples of a conventional configuration of means for holding a microphone include a configuration in which a microphone is fixed by screwing to a threaded hole provided on a microphone housing, a configuration in which a microphone is held by clipping a microphone housing by a clip, and a configuration in which a microphone is fixed by being pressed from four directions by a tip of a screw, although those are not illustrated.

However, in the configuration in which a microphone is held by sandwiching a microphone housing by the rubber bands 58 and 59 as illustrated in FIGS. 17 and 18, it is difficult to attach a microphone because a microphone housing is caught to the rubber band 58 when the microphone is attached. Further, even if the rubber band 59 is not fitted to a groove formed to a microphone housing, a microphone can be held by sandwiching only a lower portion of the microphone housing. Therefore, a user might use it improperly. A microphone might be fallen by such improper usage.

Further, a screw is visible in the configuration in which a microphone is screwed to a screw hole cut in a microphone housing shape, and a grip of a clip is conspicuous in the configuration in which a microphone housing is clipped by the clip. Therefore, there is a problem that appearance is not good in both of the configurations.

Furthermore, attaching/detaching operations are not easy in the configuration in which a microphone housing is fixed by being pressed from four directions by a tip of a screw, and also it is difficult to arrange a microphone at a center.

SUMMARY OF THE INVENTION

The present invention is focused on the above-described issues, and an object of the present invention is to provide a microphone holder in which a microphone is easily and certainly attached to and detached from and which has an excellent appearance, a step formation member used with the microphone holder, and a microphone shock mount using the microphone holder.

To solve the above-described problems, a microphone holder according to the present invention is a microphone holder holding a microphone in which an upper surface and a lower surface of a step portion are formed on an outer surface of a housing, and the microphone holder includes: holder which is formed in a cylindrical shape having openings on upper and lower sides and in which a plurality of through passages penetrating a wall of the cylindrical shaped body is provided; a sliding portion provided movably in a circumferential direction along the openings of the holder; a lock ring configured to cover the through passage formed to the holder, from an outer side by a lock plate extending from the sliding portion; and a contact member which is movably held in the through passage and can contact on an upper surface side of the step portion of the microphone, wherein the lock plate of the lock ring is arranged adjacent to a pressing portion, which presses and moves the contact member from an outer side to an inner side, and an escape hole configured to store a part of the contact member and move the part of the contact member to an outer side, and either of the pressing portion or the escape hole of the lock plate is arranged on an outer side of the through passage by turning the sliding portion of the lock ring in a predetermined direction.

The microphone holder preferably includes a locking portion by which a lower surface of the step portion of the microphone is locked.

The contact member is preferably formed in a ball shape.

The through passage preferably inclines downward toward an inner side of the holder.

A microphone is inserted into a microphone holder having such a configuration when the microphone is attached, and a lock ring rotates in a predetermined direction with respect to a holder. Accordingly, the microphone can be easily and certainly held in a locked state.

On the other hand, when the microphone is removed, the lock is unlocked by rotating the lock ring in a direction opposite to the locking direction. Accordingly, the microphone can be easily removed.

According to a configuration according to the present invention, a lock mechanism is provided in a microphone holder, and therefore a microphone holder having an excellent appearance can be provided.

In addition, to solve the above-described problems, a microphone shock mount according to the present invention is a microphone shock mount using the microphone holder, and the microphone shock mount includes: the microphone holder, a ring shaped member arranged so as to surround a periphery of the microphone holder and including a member for attaching to an outside; and a string shaped elastic member stretched between the microphone holder and the ring shaped member.

According to such a configuration, a microphone can be easily attached and detached by the above-described microphone holder, and also a microphone shock mount having an excellent appearance can be provided.

To solve the above-described problems, a step formation member according to the present invention is a step formation member used with the microphone holder, and the step formation member is formed attachably/detachably to the microphone and configured to form a step portion on a peripheral surface side of the microphone by attaching the step formation member to the peripheral surface of the microphone.

The step formation member is preferably formed of hard rubber. Alternatively, the step formation member may be formed of an annular band including a tightening portion and fixed to the microphone since a diameter of the band is decreased by tightening the tightening portion.

By using the step formation member, a step portion can be formed to a microphone which does not have a step portion on a peripheral surface, and the microphone is held by a microphone holder according to the present invention.

According to the present invention, a microphone holder in which a microphone can be easily and certainly attached and detached and which has an excellent appearance, a step formation member used with the microphone holder, and a microphone shock mount using the microphone holder can be provided.

DESCRIPTION OF THE PREFERRED EMBODIMENTS

Figure 1:
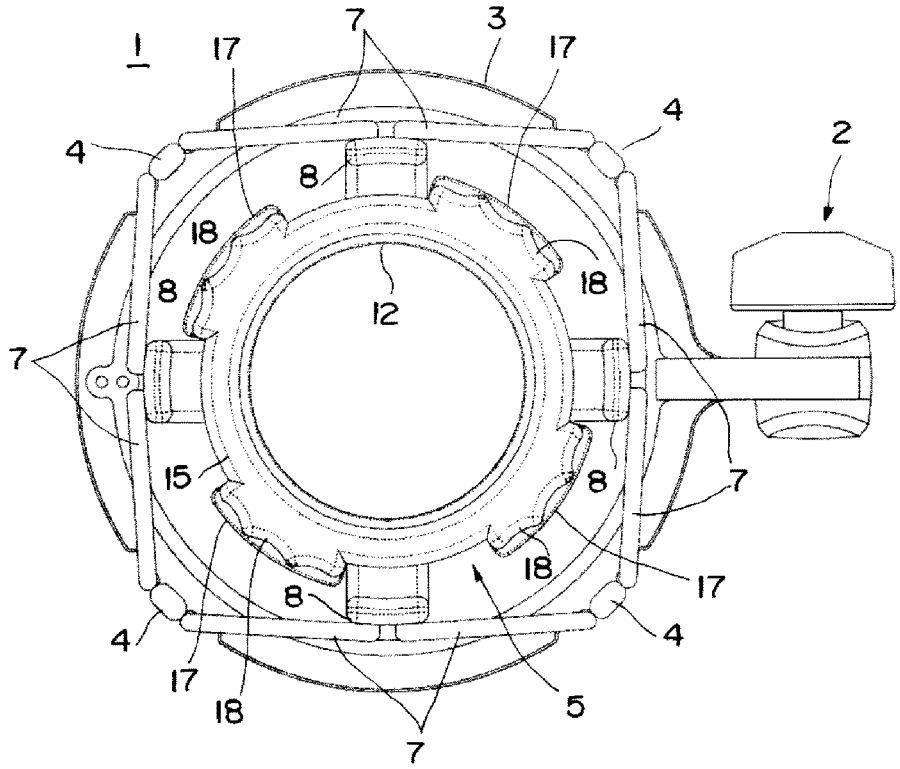
FIG. 1 is a plan view of a microphone shock mount according to the present invention.
Figure 2:
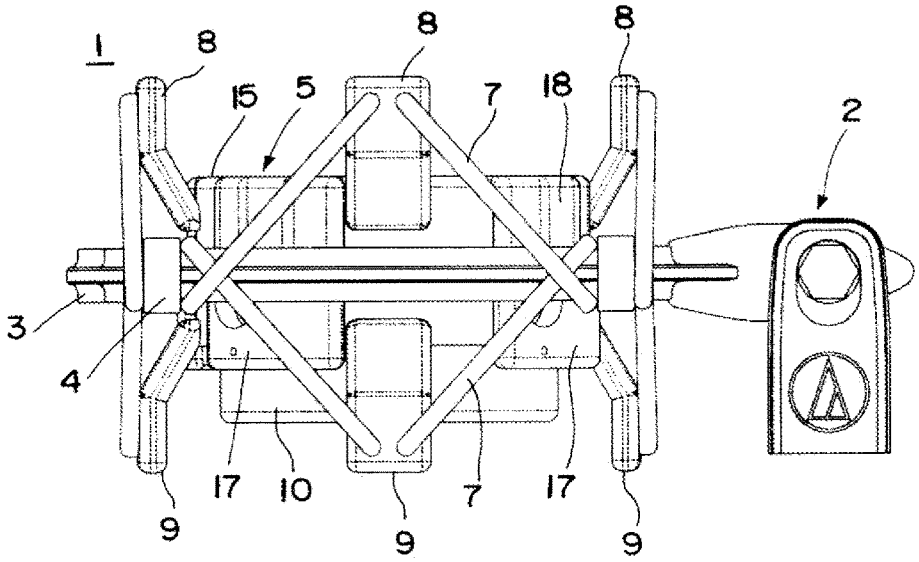
FIG. 2 is a side view of the microphone shock mount illustrated in FIG. 1.
Figure 3:
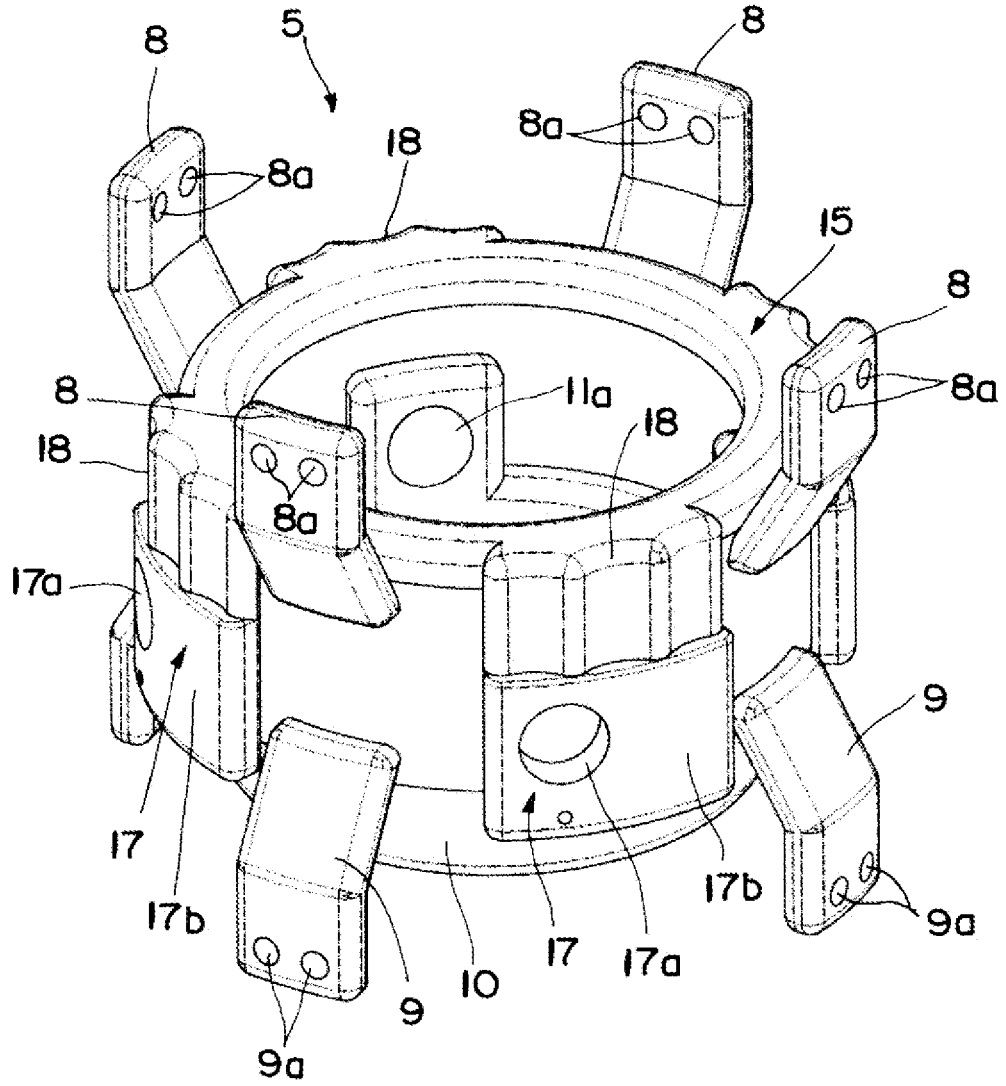
FIG. 3 is a perspective view of a microphone holder included in the microphone shock mount illustrated in FIG. 1.
Figure 4:
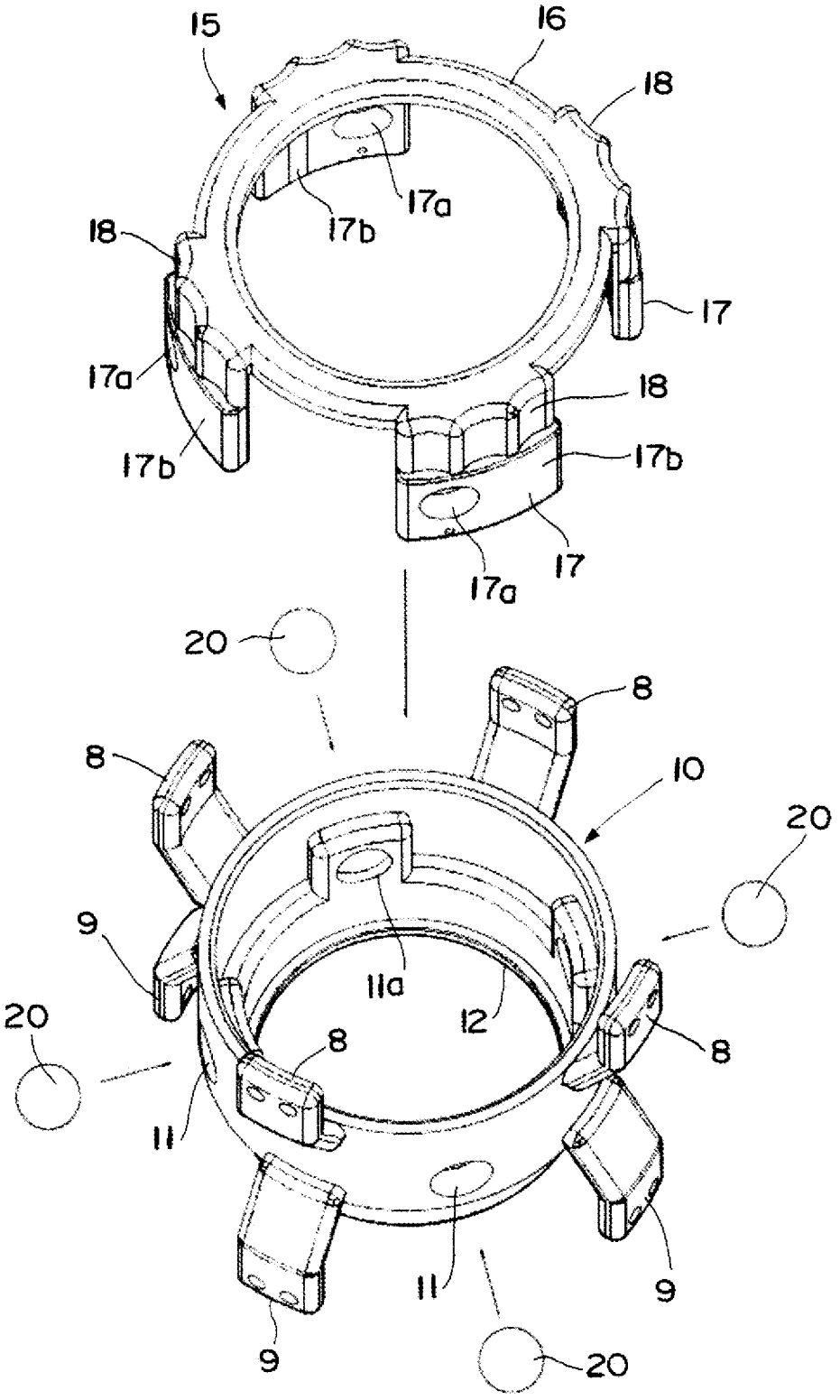
FIG. 4 is an exploded view of the microphone holder illustrated in FIG. 3.
Figure 5:
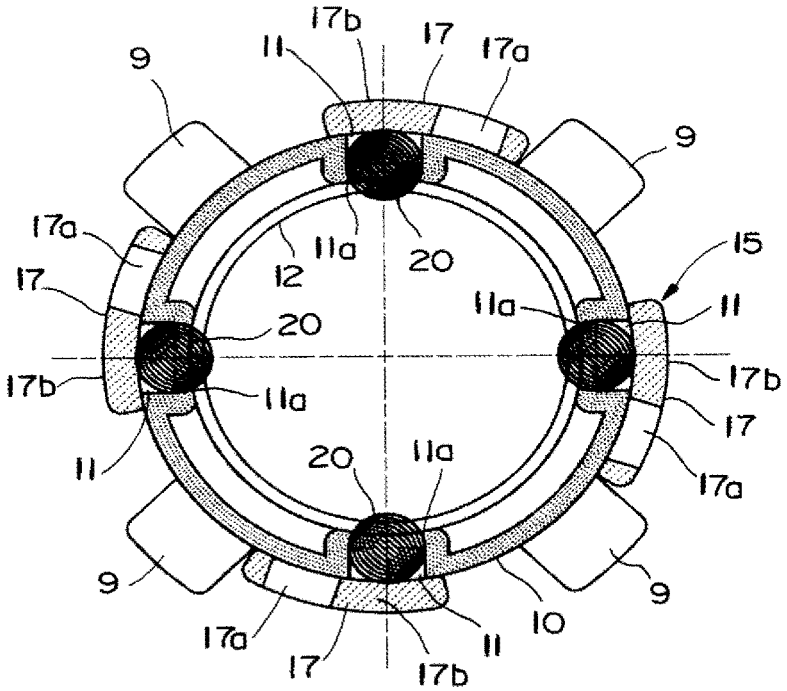
FIG. 5 is a cross-sectional view illustrating a locked state of a microphone holder.
Figure 6:
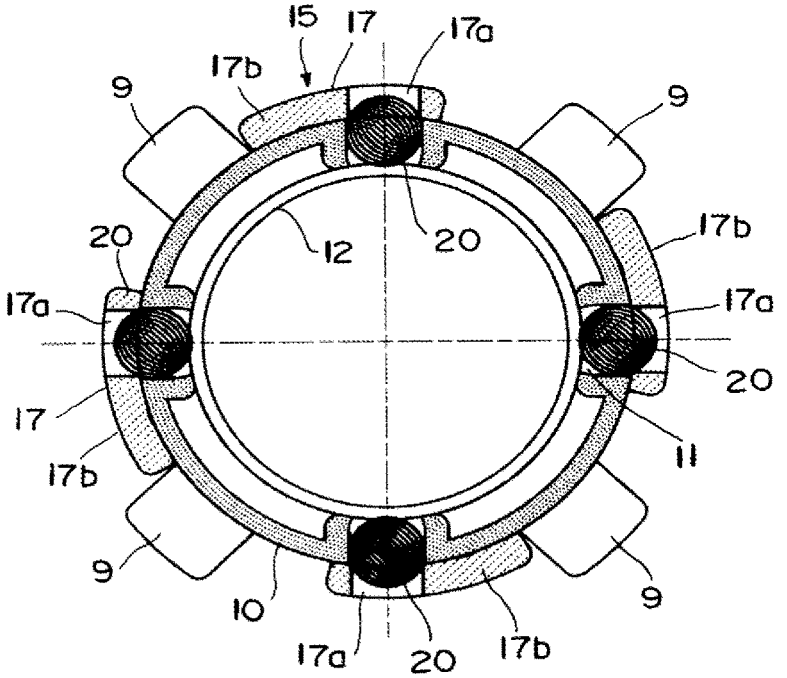
FIG. 6 is a cross-sectional view illustrating an unlocked state of a microphone holder.
Figure 7:
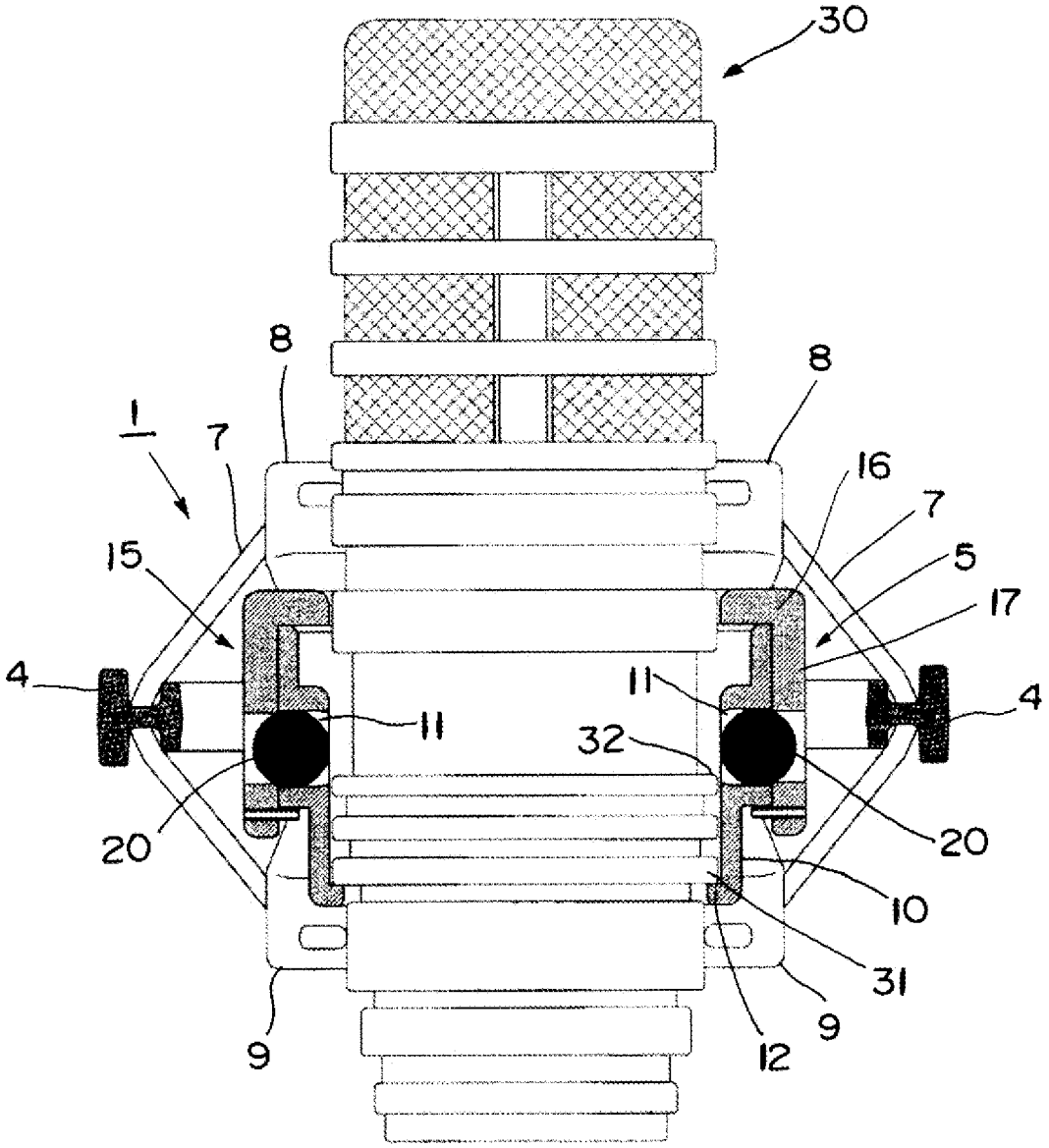
FIG. 7 is a longitudinal sectional view illustrating an unlocked state in which a microphone is inserted into the microphone shock mount illustrated in FIG. 1.
Figure 8:
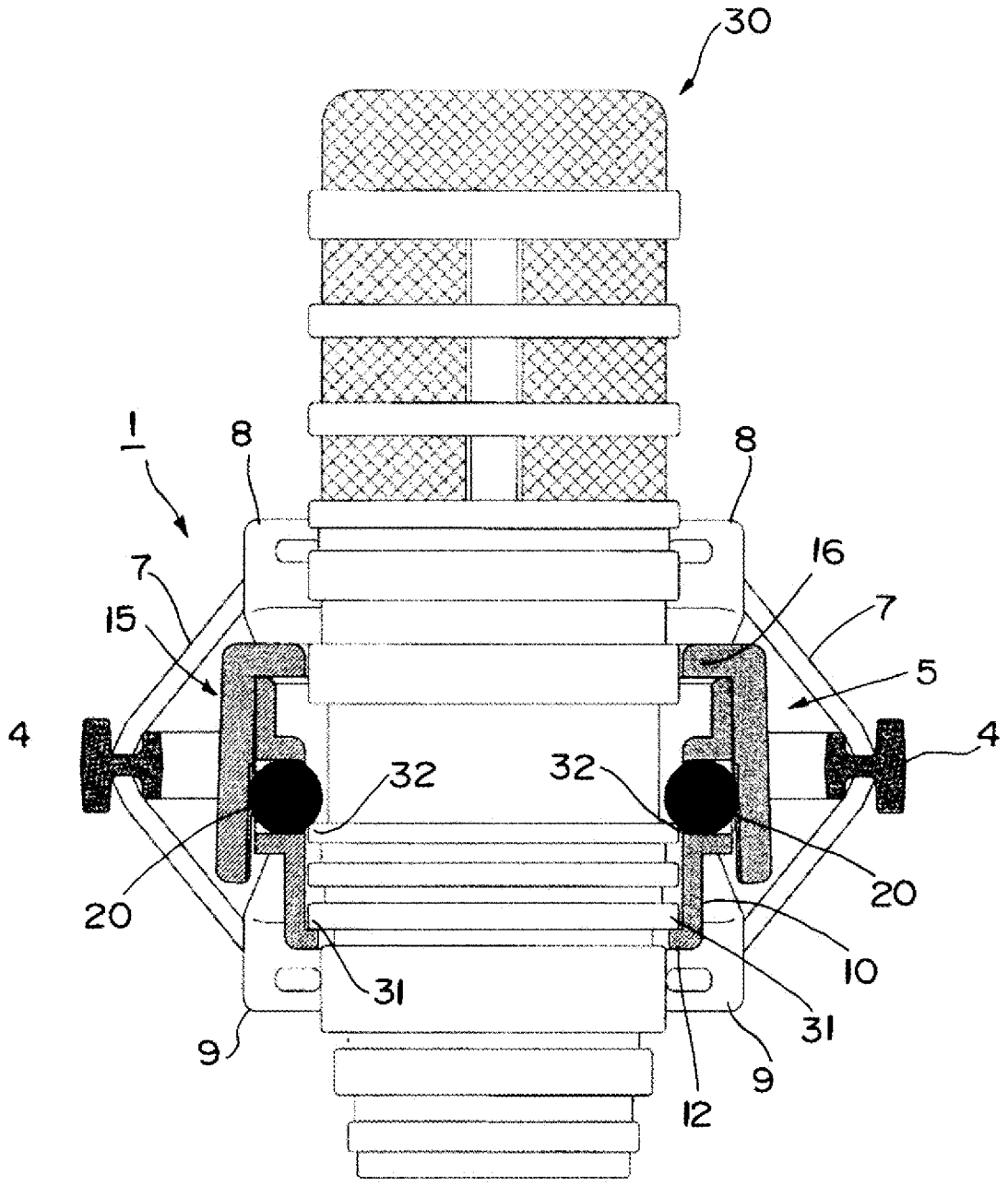
FIG. 8 is a longitudinal sectional view illustrating a locked state in which a microphone is inserted into the microphone shock mount illustrated in FIG. 1.

An embodiment of the present invention will be described below with reference to FIGS. 1 to 8. FIG. 1 is a plan view of a microphone shock mount according to the present invention, and FIG. 2 is a side view of the same. FIG. 3 is a perspective view of a microphone holder included in the microphone shock mount illustrated in FIG. 1, and FIG. 4 is an exploded view of the same. FIG. 5 is a cross-sectional view illustrating a locked state of a microphone holder included in the microphone shock mount illustrated in FIG. 1, and FIG. 6 is a cross-sectional view illustrating an unlocked state. FIG. 7 is a longitudinal sectional view illustrating an unlocked state in which a microphone is inserted into the microphone shock mount illustrated in FIG. 1, and FIG. 8 is a longitudinal sectional view illustrating a locked state.

As illustrated in FIGS. 1 and 2, a microphone shock mount 1 includes an outer peripheral member 3 which is a large diameter ring (a ring shaped member) and a microphone holder 5 arranged in the outer peripheral member 3.

A screw portion 2 (attaching member) is provided by connecting to an outer peripheral surface of the ring-shaped outer peripheral member 3, and the microphone shock mount 1 is connected by screwing to a microphone stand (not illustrated).

A hook 4 projected in a button shape is arranged at equal intervals in a circumferential direction at multiple points (four points in the figure) on an outer peripheral surface of the outer peripheral member 3. Around rubber string 7 (elastic member) can hook to this hook 4.

A microphone holder 5 is formed in a cylindrical shape, and multiple (four in the figure) projecting portions 8 are arranged at equal intervals along a circumferential direction on an upper peripheral surface thereof. Each projecting portion 8 is provided so as to project upward, and the round rubber string 7 is inserted through two through holes 8*a* (see FIG. 3) formed at a tip of each projecting portion 8.

Multiple (four in the figure) projecting portions 9 are arranged at equal intervals along a circumferential direction on a lower outer peripheral surface of the microphone holder 5 so as to be vertically symmetric with respect to the projecting portion 8. Each projecting portion 9 is provided so as to project downward, and the round rubber string 7 is inserted through two through holes 9*a* (see FIG. 3) formed at a tip of each projecting portion 9.

As illustrated in FIGS. 1 and 2, the round rubber string 7 is stretched between the hook 4 of the outer peripheral member 3 and the projecting portions 8 and 9 of the microphone holder 5. The microphone holder 5 is held in a state of floating in a hollow in the ring-shaped outer peripheral member 3 by having elasticity by the round rubber string 7. Specifically, the microphone holder 5 is reciprocably held in a vertical direction with respect to the outer peripheral member 3 by the round rubber string 7, and vibration is absorbed.

Next, a configuration of the microphone holder 5 will be described in detail.

FIG. 3 is a perspective view of the microphone holder 5. FIG. 4 is an exploded view of the microphone holder 5. As illustrated in FIG. 4, the microphone holder 5 is assembled by three members, roughly classified. Specifically, the microphone holder 5 includes the cylindrical-shaped holder 10, a lock ring 15 attached so as to cover from above the holder 10, and multiple (four in the figure) balls 20 (contact member). The holder 10 has a cylindrical shape which vertically opens and includes the projecting portions 8 and 9. In addition, multiple through passages 11 are formed on a wall of the holder 10, and the balls 20 are held in the through passages 11. The lock ring 15 can rotate within a predetermined range in a circumferential direction with respect to the holder 10.

In the present embodiment, the holder 10 is formed of a resin material, and the lock ring 15 and the ball 20 are formed of a resin material, such as polyacetal resin (POM), having a certain hardness and friction resistance. A reason why POM resin is preferable to a material of the ball 20 is that the POM resin is softer and has a lighter weight than metal. Further, POM resin has a friction force suitable for holding a microphone. In the case where the ball 20 is a metal ball such as an iron ball, a housing of a microphone 30 might be scratched by friction, and the weight thereof is too heavy. Further, in the case where the ball 20 is formed of rubber and silicon, there is a problem that a friction force is too strong when the lock ring 15 is rotated, and a surface is roughened in an early stage due to aging deterioration. Therefore, POM resin or a material having physical property similar to the POM resin is preferably used in a material of the ball 20 according to the present embodiment.

A microphone is inserted into the cylindrical holder 10. As illustrated in FIG. 4, a lower end of the holder 10 is folded inward, and a flange portion 12 (locking portion) is formed. This flange portion 12 is for locking a lower surface side of a step portion formed to a microphone housing. On a wall of the holder 10, multiple (four in the figure) through passages 11, for example, horizontally penetrating in a radial direction as described above are formed at equal intervals in a circumferential direction. The balls 20 are stored in the through passages 11 so as to be movable in a radial direction. An opening 11*a* communicated with the through passage 11 is provided on an inner peripheral surface side of the holder 10.

A diameter of the through passage 11 is larger than a diameter of the ball 20. A diameter of the opening 11*a* is smaller than a diameter of the ball 20. The ball 20 moves to a radial direction inner side in the through passage 11, and therefore a part of the ball 20 projects from the opening 11*a*.

Further, the lock ring 15 includes a ring-shaped slider 16 (sliding portion) rotatable in a circumferential direction and multiple lock plates 17 extended and suspended from the ring-shaped slider 16. The ring-shaped slider 16 is rotatable in a circumferential direction by using an upper end of the cylindrical holder 10 as a rail. In addition, the lock plate 17 is provided at equal intervals at multiple portions (four in the figure) along a circumferential direction of the ring-shaped slider 16. A grip 18 is provided at an upper side of the lock plate 17. A recessed wave is formed on a surface of the grip 18 so as to easily grip the lock ring 15 by the palm when the lock ring 15 is rotated.

The four lock plates 17 contact with an outer peripheral surface of the holder 10 and are arranged so as to cover each of multiple through passages 11. The lock plate 17 includes an escape hole 17*a* and a plate-like pressing portion 17*b*. A diameter of the escape hole 17*a* is smaller than a diameter of the ball 20, and the plate pressing portion 17*b* is provided next to the escape hole 17*a*. By sliding and rotating the lock ring 15 within a predetermined rotation range, either of the escape hole 17*a* or the pressing portion 17*b* of the lock plate 17 is arranged on an outer side of the through passage 11 of the holder 10.

Herein, a usage state of the microphone holder 5 will be described. FIG. 5 illustrates a state in which a microphone is held (fixed). FIG. 6 illustrates an unlocked state. In the state illustrated in FIG. 6 (initial state), a microphone housing is inserted into the holder 10. When the microphone housing is inserted, the lock ring 15 is rotated in a predetermined direction (a clockwise direction in the embodiment), and the pressing portion 17*b* of the lock plate 17 is arranged on an outer side of the through passage 11 as illustrated in FIG. 5. At this time, the pressing portion 17*b* presses the ball 20 and moves the ball 20 on a radial direction inner side. Therefore, the ball 20 is projected from the opening 11*a* on an inner side of the holder 10, and the microphone housing is fixed (a locked state). When the housing is locked, the microphone housing is made of metal, and the lock ring 15 is made of resin. Therefore, the pressing portion 17*b* of the lock ring 15 is bent to an outer side by being pressed by the ball 20. At this time, proper friction and a click feeling in the locked state are generated by an elastic force of the pressing portion 17*b* generating and a force to press the ball 20.

Further, the ball 20 is a sphere, and the pressing portion 17*b* is elastic. Therefore, a difference in size by variation in production is allowed, and a microphone housing can be certainly held. The ball 20 contacts at a point, not on a plane with respect to a housing of the microphone 30. Therefore, rattling in a locked state can be prevented. Further, the ball 20 is fitted to a groove on an inner side of the lock plate 17, and the ball 20 has an effect equivalent to a latch on the lock ring 15. Therefore, the ball 20 also plays a role on preventing unexpected rotation of the lock ring 15.

On the other hand, when the lock ring 15 rotates in an opposite direction (counter clockwise direction in the present embodiment) with respect to the holder 10, the escape hole 17*a* of the lock plate 17 is arranged on an outer side of the through passage 11 as illustrated in FIG. 6. At this time, the ball 20 moves to a radial direction outer side (escape hole 17*a* side). Accordingly, the ball 20 returns to a state in which the ball 20 does not project from the inner side opening 11*a* of the holder 10 (unlocked state). In this unlocking operation, the ball 20 is released from the state in which the ball 20 comes into contact with a microphone housing and moves to the escape hole 17*a* of the lock plate 17. Specifically, a complicated unlocking mechanism is not necessary in the microphone holder 5. The ball 20 freely rotates in the through passage 11 and the escape hole 17*a*. Attachment/detachment of a microphone housing is easy because the rotation of the ball 20 prevents generation of an unnecessary friction force when the microphone housing is attached and detached.

In the case where a microphone is held by the microphone shock mount 1 configured as described above, the microphone 30 is inserted from an upper side into the unlocked microphone holder 5 (holder 10) as illustrated in FIG. 7. At this time, the flange portion 12 arranged at a lower end of the holder 10 locks a lower surface of a step portion 31 formed to a housing of the microphone 30.

Next, when the lock ring 15 rotates in a predetermined direction, the pressing portion 17*b* of the lock plate 17 presses the ball 20 as illustrated in FIG. 8. The ball 20 moves to a radial direction inner side in the through passage 11 and projects from the opening 11*a*.

In this state, the ball 20 comes into contact with an upper surface side of a step portion 32 of the microphone 30. When the ball 20 comes into contact, a step portion of a microphone housing is sandwiched (a locked state) between the ball 20 and the flange portion 12, and the microphone 30 is held by a microphone holder.

On the other hand, holding of the microphone 30 is unlocked by turning the lock ring 15 in an opposite direction. As illustrated in FIG. 7, the escape hole 17*a* is again arranged on an outer side of the through passage 11 by rotation of the lock ring 15. Accordingly, the ball 20 moves to the escape hole 17*a* side, and the locked state is released.

According to the above-described embodiment according to the present invention, when the lock ring 15 rotates in a predetermined direction, the microphone 30 attached to the microphone holder 5 can be easily held in a locked state. On the other hand, the lock is unlocked when the lock ring 15 rotates in a direction opposite to a locking direction. Therefore, attachment, detachment, and fixing of the microphone 30 become easy.

According to a configuration according to the present invention, a locking mechanism is provided inside the microphone holder 5, and therefore the microphone holder 5 and the microphone shock mount 1 having excellent appearance can be provided.

In the above-described embodiment, the through passage 11 provided to the holder 10 is horizontally provided in a radial direction, but not limited to the configuration.

Figure 9:
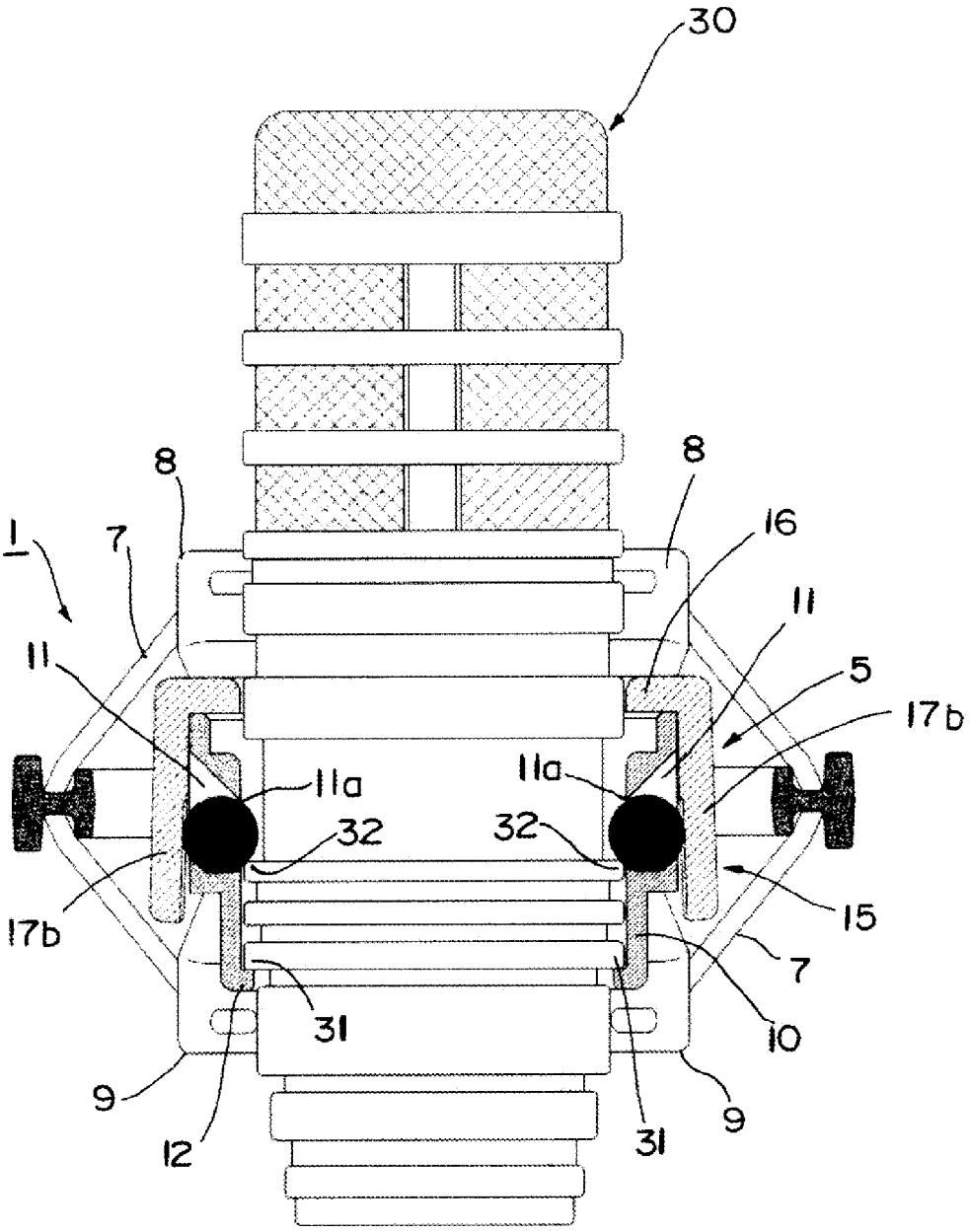
FIG. 9 illustrates a variation of the microphone shock mount according to the present invention, and is a longitudinal sectional view illustrating a locked state.
Figure 10:
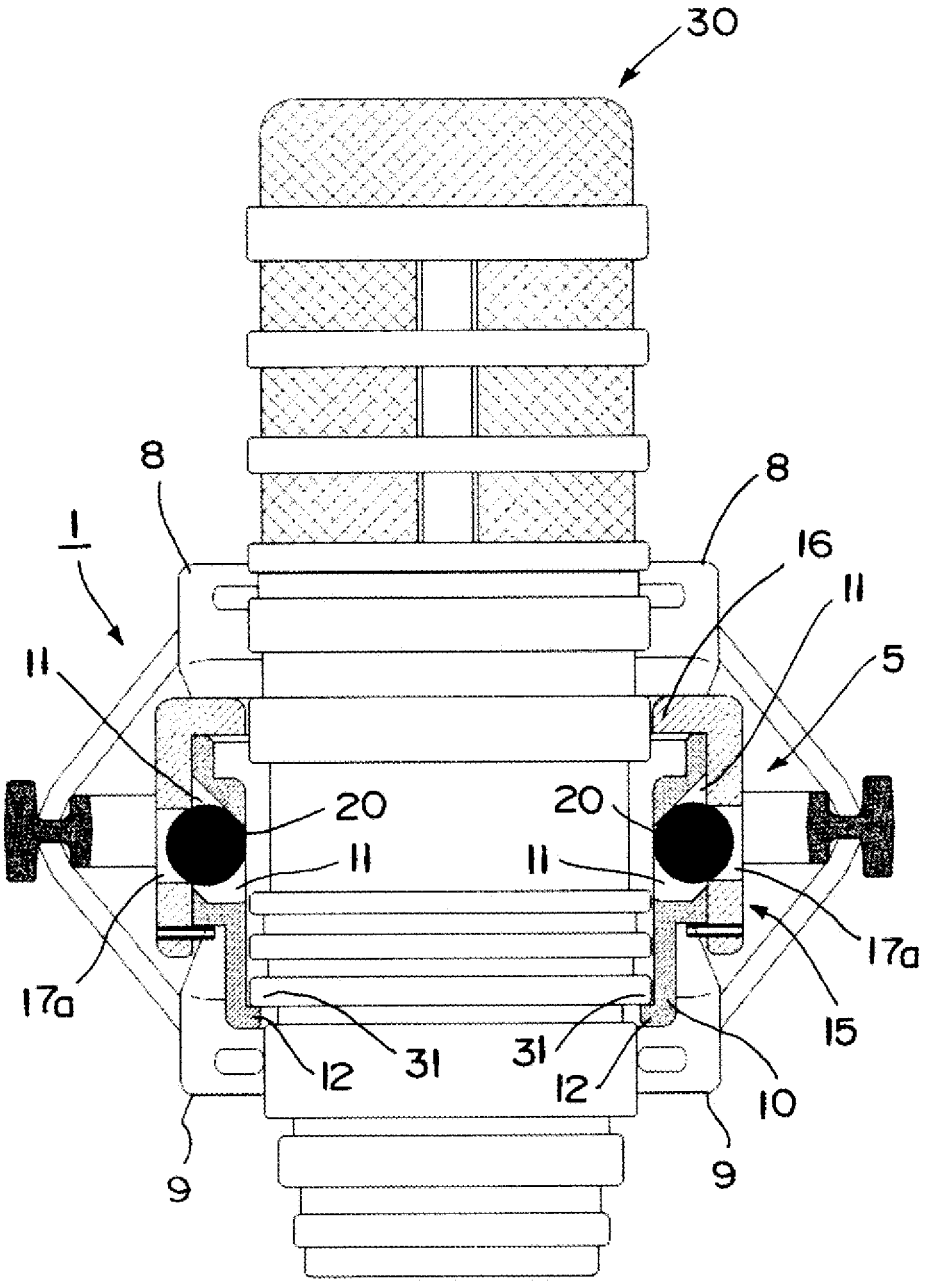
FIG. 10 illustrates a variation of the microphone shock mount according to the present invention, and is a longitudinal sectional view illustrating an unlocked state.

For example, as illustrated in FIGS. 9 and 10, the through passage 11 may be formed so as to incline downward toward a radial direction inner side. FIGS. 9 and 10 illustrate variations of a microphone shock mount. FIG. 9 is a sectional view illustrating a locked state, and FIG. 10 is a sectional view illustrating an unlocked state.

In the case where the through passage 11 inclined in such a way is formed, the ball 20 does not fall down from the through passage 11 when a microphone holder is assembled. Therefore, assembly becomes easy, and operability is improved. In addition, the through passage 11 is inclined downward on a housing side of the microphone 30. Therefore, all of the balls 20 certainly come into contact with a housing (the step portion 32) of the microphone 30 when locking. Therefore, a microphone can be certainly held and fixed.

In the above-described embodiment, a cylindrical housing of the microphone 30 (perfect circle cross-section) is illustrated as an example. However, in the present invention, a housing shape of the microphone 30 which can be held by the microphone holder 5 is not limited thereto.

Figure 11:
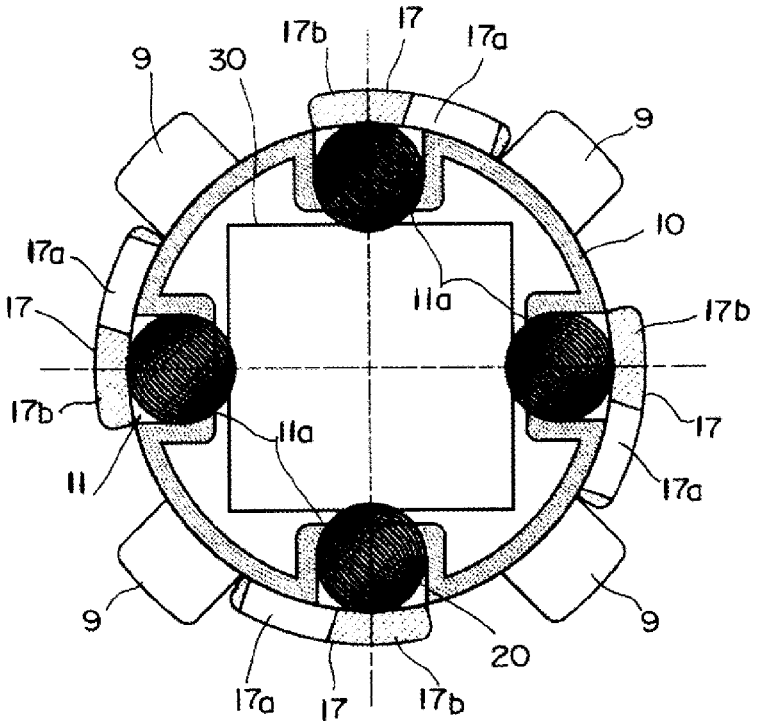
FIG. 11 is a cross-sectional view illustrating a locked state of the microphone holder according to the present invention, which holds a microphone in which a cross section is a rectangular shape.
Figure 12:
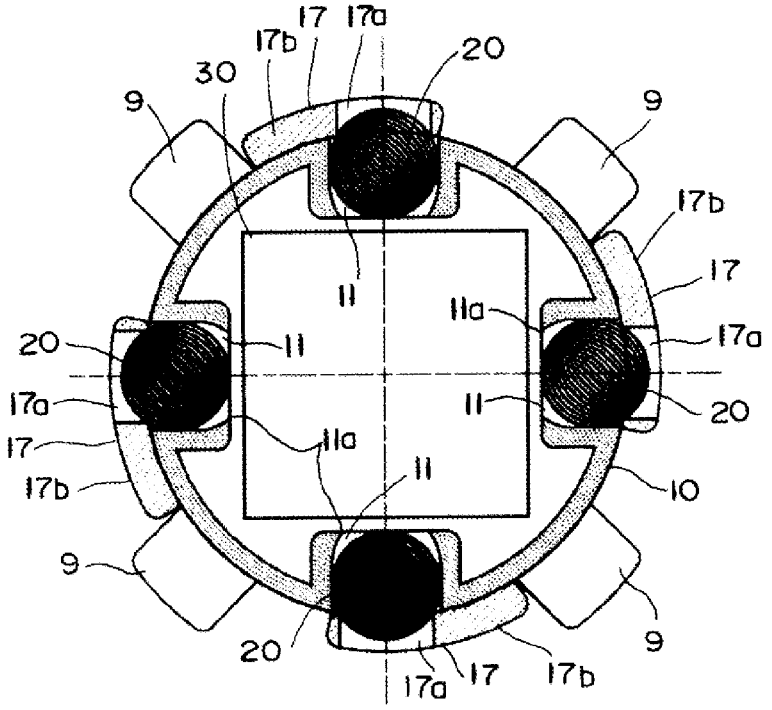
FIG. 12 is a cross-sectional view illustrating an unlocked state of the microphone holder according to the present invention, which holds a microphone in which a cross section is a rectangular shape.

For example, as illustrated in a sectional view (a locked state) of FIG. 11 and a sectional view (an unlocked state) of FIG. 12, even if a cross section (a plane shape of a step portion) of a housing of the microphone 30 is a rectangular shape, the microphone 30 can be held.

Figure 13:
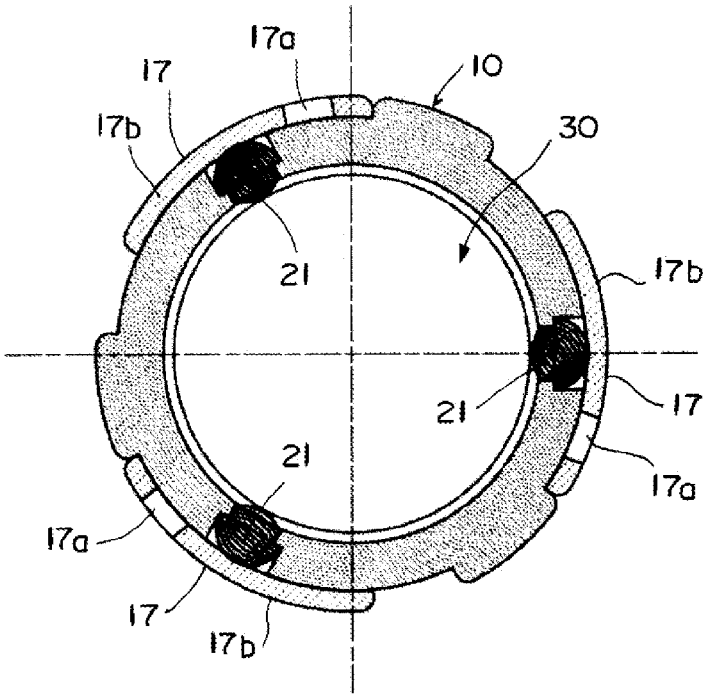
FIG. 13 illustrates another variation of the microphone holder according to the present invention, and is a cross-sectional view illustrating a locked state.
Figure 14:
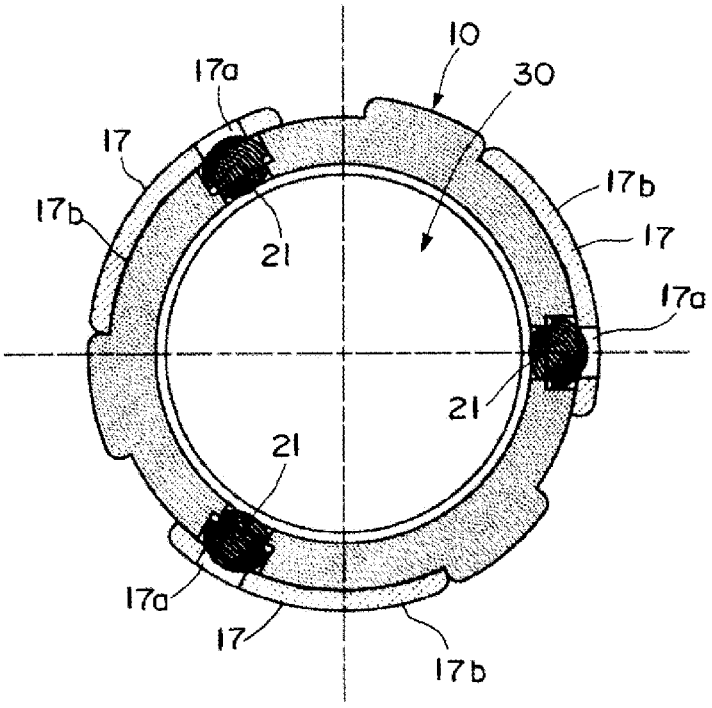
FIG. 14 illustrates another variation of the microphone holder according to the present invention, and is a cross-sectional view illustrating an unlocked state.

In the above-described embodiment, the spherical ball 20 is stored in the through passage 11 as a contact member, and locking and unlocking are performed by rotating and moving the ball 20. However, the contact member is not limited to the spherical ball 20. For example, as illustrated in a cross-sectional view (locked state) of FIG. 13 and a cross-sectional view (unlocked state) of FIG. 14, a contact member 21 in which curvatures of spherical surfaces on an inner side and an outer side are different may be used.

Figure 15A:
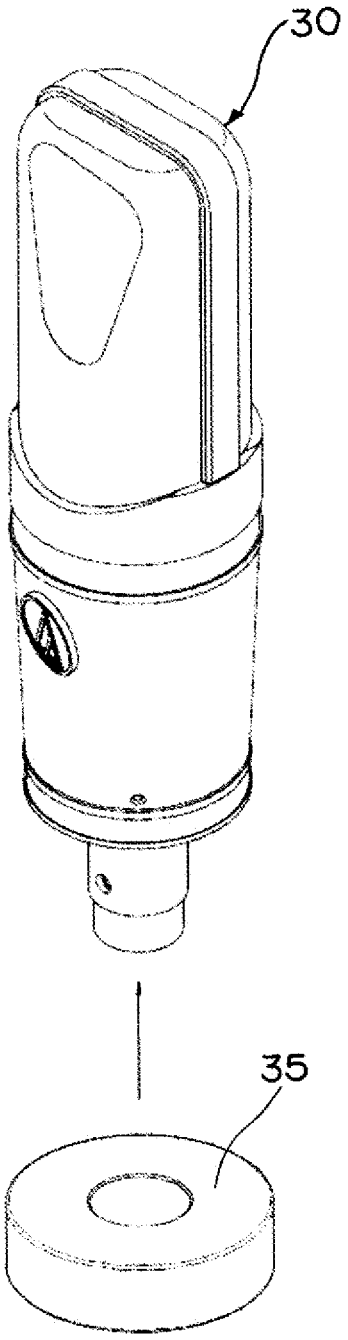
FIGS. 15A and 15B are perspective views of a microphone in which a first adapter is mounted.
Figure 15B:
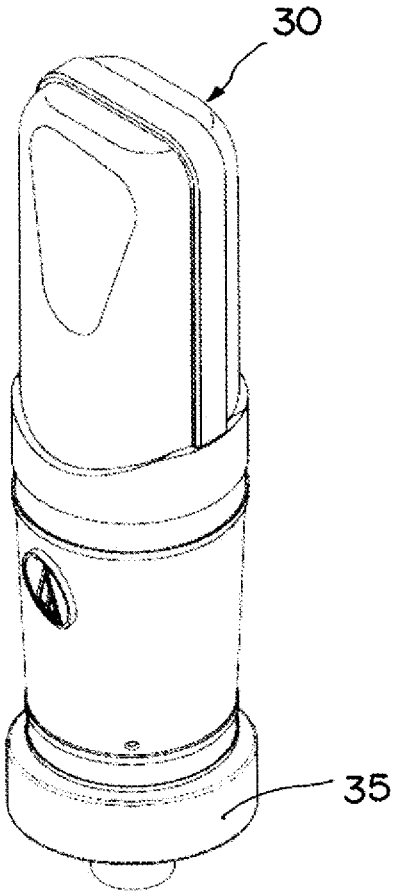

In the above-described embodiment, with respect to the microphone 30 including the step portions 31 and 32 in a housing, the flange portion 12 and the ball 20 are locked to the step portions 31 and 32. However, regarding a microphone holder according to the present invention, the microphone 30 which does not include a projecting portion like the step portions 31 and 32 as illustrated in FIG. 15A can be held by inserting to a ring-shaped first adapter 35 (step formation member) and forming a projecting portion as illustrated in FIG. 15B Further, in the present embodiment, the holder 10 is made of resin. However, a material forming the holder 10 is not limited to resin materials and may be, for example, a metal material.

Figure 16A:
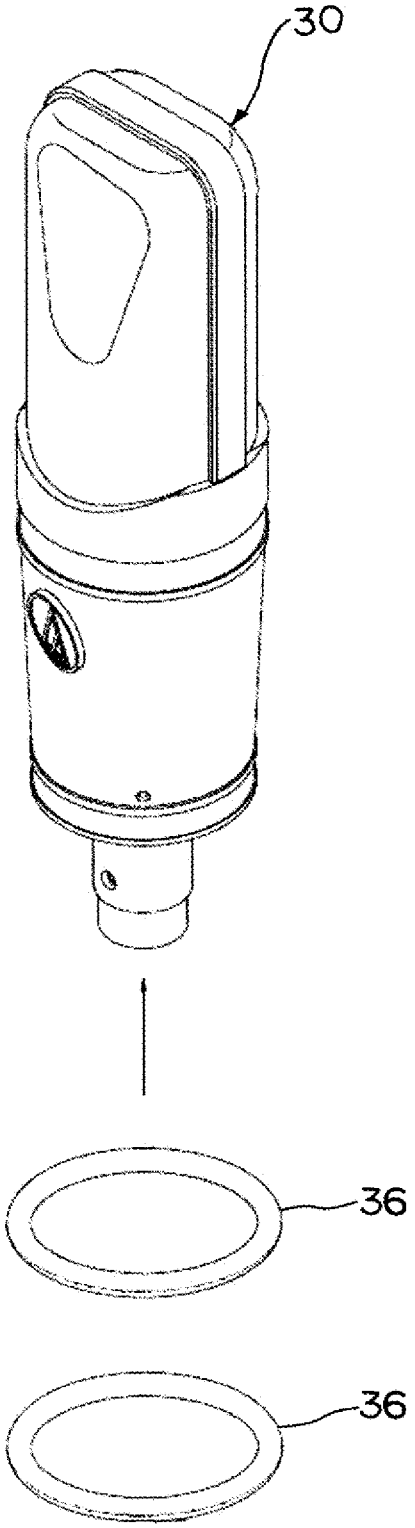
FIGS. 16A and 16B are perspective views of a microphone in which a second adapter is mounted.
Figure 16B:
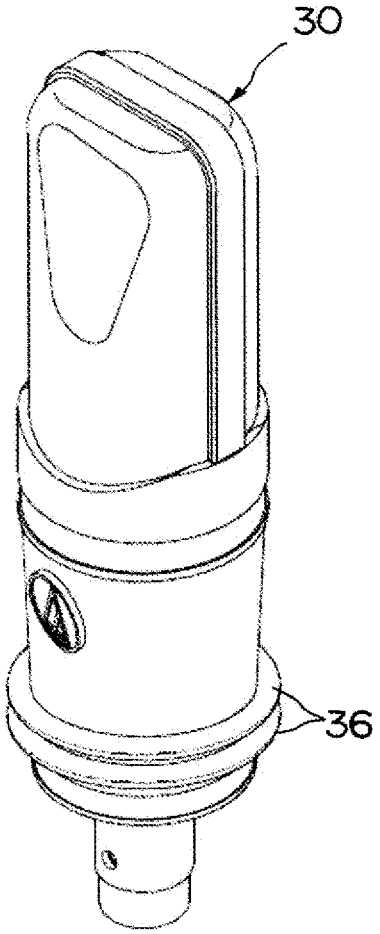
Figure 17:
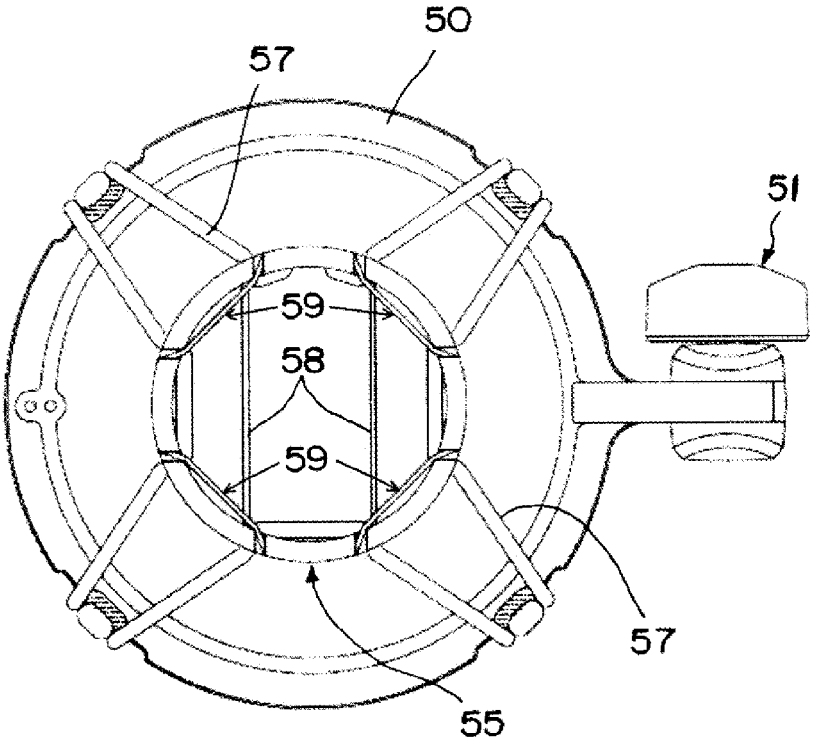
Fig. 17 Prior Art
FIG. 17 is a plan view of a conventional microphone shock mount.
Figure 18:
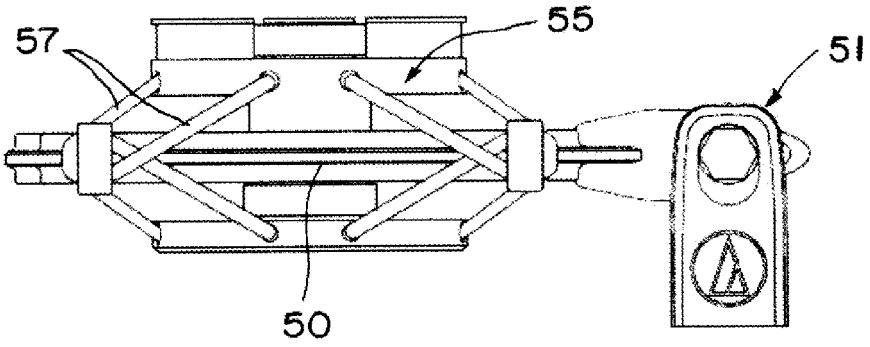
Fig. 18 Prior Art
FIG. 18 is a side view of a conventional microphone shock mount.

The adapter 35 is made of hard rubber, resin, and metal, and can be attached to a microphone housing. The adapter which is a step formation member is not limited to the adapters illustrated in FIGS. 15A and 15B. It may be two ring-shaped adapters 36 and 36 (second adapters) as illustrated in FIGS. 16A and 16B. In the case where the adapter is made of hard rubber, the adapter may have a ring shape or a cylindrical shape, which is formed slightly smaller than an outer diameter of a microphone housing. In this case, the adapter 35 or 36 is certainly fixed to a microphone housing by elasticity and a friction force of a rubber. In the case where the adapter is made of resin or metal, the adapter is a cylindrical member or annular member. The cylindrical adapter 35 is directly fixed to a microphone by such as a screw. The annular adapters 36 and 36 include, for example, a tightening portion to decrease a diameter of an annular band by screw-tightening and pulling a fitting portion, and the adapters may be fixed so as to tighten a microphone housing. The adapters 36 and 36 including the tightening portion may be configured similar to a binding band made of resin or metal.

What is claimed is:

1. A microphone holder holding a microphone in which an upper surface and a lower surface of a step portion are formed on an outer surface of a housing of the microphone, the microphone holder comprising:

a holder which includes a cylindrical shaped body having openings on upper and lower sides, and a through passage penetrating a wall of the cylindrical shaped body, wherein the microphone is inserted through the openings of the holder;

a lock ring which includes a sliding portion provided movably in a circumferential direction along the openings of the holder, and a lock plate extending from the sliding portion to cover the through passage formed in the holder from an outer side of the holder; and a contact member which is movably held in the through passage and contactable to an upper surface side of the step portion of the microphone, wherein the lock plate of the lock ring includes a pressing portion, which presses and moves the contact member from the outer side of the holder toward an inner side of the holder, and an escape hole arranged adjacent to the pressing portion, and configured to store a part of the contact member to allow the part of the contact member to move toward the outer side of the holder, and either of the pressing portion or the escape hole of the lock plate is arranged on an outer side of the through passage by turning the sliding portion of the lock ring in the circumferential direction of the holder.

2. The microphone holder according to claim 1, wherein the holder comprises a locking portion configured to lock the lower surface of the step portion of the microphone.

3. The microphone holder according to claim 1, wherein the contact member is formed in a ball shape.

4. The microphone holder according to claim 1, wherein the through passage inclines downward toward the inner side of the holder.

5. The microphone holder according to claim 1, wherein the holder further comprises a plurality of through passages penetrating the wall of the cylindrical shaped body, and the contact member further comprises a plurality of contact members, each being held in each of the plurality of through passages.

* * * * *